US012686417B2

(12) United States Patent
Hoeck et al.

(10) Patent No.: US 12,686,417 B2
(45) Date of Patent: Jul. 21, 2026

(54) CABLEWAY FOR TRANSPORTING GOODS

(71) Applicant: Innova Patent GmbH, Wolfurt (AT)

(72) Inventors: Jari Hoeck, Hard (AT); Gerd Dür, Bildstein (AT)

(73) Assignee: INNOVA PATENT GMBH, Wolfurt (AT)

( * ) Notice: Subject to any disclaimer, the term of this patent is extended or adjusted under 35 U.S.C. 154(b) by 528 days.

(21) Appl. No.: 18/468,459

(22) Filed: Sep. 15, 2023

(65) Prior Publication Data

US 2024/0092401 A1 Mar. 21, 2024

(51) Int. Cl.

| | |
|---|---|
| ***B61B 7/04*** | (2006.01) |
| ***B61B 12/00*** | (2006.01) |
| ***B61B 12/06*** | (2006.01) |
| ***B61B 15/00*** | (2006.01) |

(52) U.S. Cl.

CPC ..... *B61B 7/04* (2013.01); *B61B 12/002* (2013.01); *B61B 12/06* (2013.01); *B61B 15/00* (2013.01)

(58) Field of Classification Search

CPC ..... B61B 12/00; B61B 12/002; B61B 12/06; B61B 15/00; B61B 7/04

See application file for complete search history.

(56) References Cited

U.S. PATENT DOCUMENTS

| | | | | |
|---|---|---|---|---|
| 11,198,450 | B2 | 12/2021 | Mathis et al. | |
| 11,661,093 | B2 * | 5/2023 | Vichier Guerre | B61B 12/06 104/178 |
| 12,509,126 | B2 * | 12/2025 | Dür | B61B 1/02 |
| 2007/0251407 | A1 | 11/2007 | Gabriel | |
| 2008/0011183 | A1 * | 1/2008 | Fischer | B61B 12/105 104/123 |
| 2008/0229966 | A1 | 9/2008 | Luger | |
| 2017/0166227 | A1 * | 6/2017 | Martin | B61B 1/02 |

(Continued)

FOREIGN PATENT DOCUMENTS

| | | | |
|---|---|---|---|
| AT | A3952001 | A | 11/2005 |
| AT | 414056 | B | 8/2006 |

(Continued)

OTHER PUBLICATIONS

Search Report Dated Jul. 20, 2023 for Austrian Patent Application No. A50709/2022.

(Continued)

*Primary Examiner* — Jason C Smith

(74) *Attorney, Agent, or Firm* — Husch Blackwell LLP

(57) ABSTRACT

A circulating cableway having at least two cableway stations and a plurality of cableway vehicles which can be moved between the cableway stations with a conveyor cable, wherein each cableway vehicle has a cabin for receiving objects, and wherein a control unit is provided for controlling the circulating cableway, also includes a first detection device in at least a first of the at least two cableway stations configured to detect an object provided for loading in a cabin of a cableway vehicle in a loading region of the first cableway station and to determine an object type for the object, and wherein the control unit is configured to operate the circulating cableway in a defined transport operating mode when the object type determined for the object is a specified object type. An associated method of operating a circulating cableway is also disclosed.

20 Claims, 1 Drawing Sheet

(56) References Cited

U.S. PATENT DOCUMENTS

| | | | | |
|---|---|---|---|---|
| 2020/0156665 | A1* | 5/2020 | Hofmayr | B61B 12/002 |
| 2021/0016813 | A1 | 1/2021 | Queen | |
| 2021/0245788 | A1* | 8/2021 | Plantard | B61B 7/04 |
| 2022/0035380 | A1* | 2/2022 | Bojarski | G06Q 50/40 |
| 2022/0153316 | A1* | 5/2022 | Rueda | B61B 15/00 |
| 2023/0088063 | A1* | 3/2023 | Dür | B61B 1/02 104/28 |
| 2024/0092401 | A1* | 3/2024 | Hoeck | B61B 15/00 |

FOREIGN PATENT DOCUMENTS

| | | | | | |
|---|---|---|---|---|---|
| AU | 2021226837 | A1 | * | 9/2022 | B61B 12/04 |
| CN | 106394566 | A | * | 2/2017 | B61B 12/00 |
| CN | 106985830 | A | * | 7/2017 | B61B 1/02 |
| CN | 106394566 | B | | 10/2018 | |
| CN | 110167820 | A | * | 8/2019 | B61B 12/10 |
| CN | 110914132 | A | * | 3/2020 | B61B 7/00 |
| CN | 110167820 | B | | 12/2020 | |
| CN | 110914132 | B | | 2/2022 | |
| CN | 115151471 | A | * | 10/2022 | B61B 12/04 |
| CN | 115151471 | B | * | 11/2023 | B61B 12/04 |
| EP | 1849674 | A1 | | 10/2007 | |
| EP | 1972520 | A1 | | 9/2008 | |
| JP | 2009122863 | A | | 6/2009 | |
| JP | 6261762 | B2 | * | 1/2018 | B61B 12/105 |
| KR | 20220157977 | A | * | 11/2022 | B61B 12/04 |
| WO | WO-2019208278 | A1 | * | 10/2019 | H04N 7/18 |

OTHER PUBLICATIONS

European Search Report dated Feb. 1, 2024 for European Application No. 23197460.1.

Machine Translation of JP2009122863A.

First Chinese Office Action for Application No. 202311200519.X, dated Jan. 10, 2026, 10 pages.

* cited by examiner

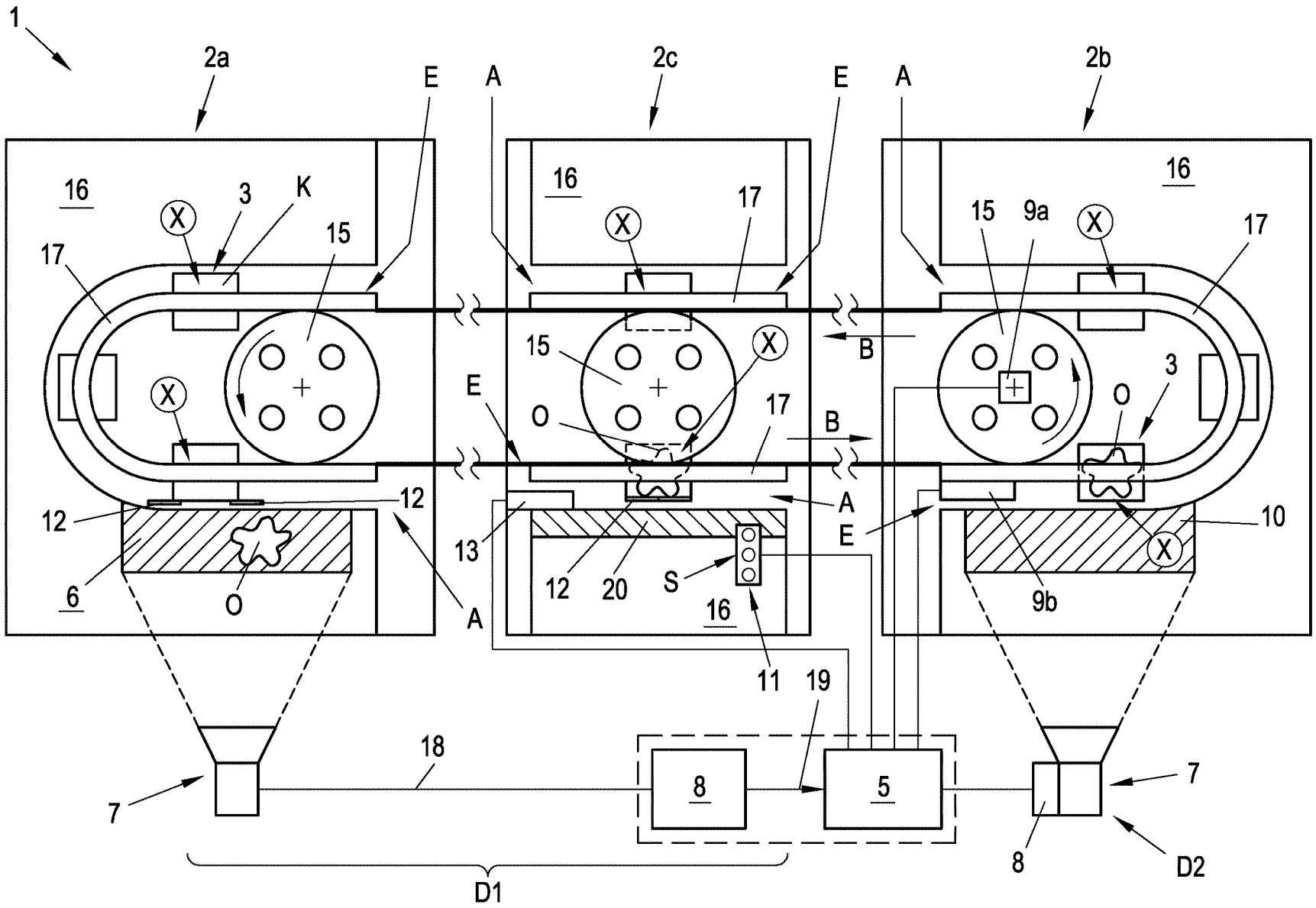
1
2a
2b
2c
3
5
6
7
8
9a
9b
10
11
12
13
15
16
17
18
19
20
A
B
D1
D2
E
K
O
S

CABLEWAY FOR TRANSPORTING GOODS

CROSS REFERENCE

This application claims priority to Austrian Patent Application No. A50709/2022 filed on 15 Sep. 2022, the disclosure of which is incorporated herein by reference in its entirety.

TECHNICAL FIELD

The present disclosure relates to a circulating cableway having at least two cableway stations and having a number of cableway vehicles which can move between the cableway stations by means of a conveyor cable, wherein the number of cableway vehicles each has a cabin for receiving objects, and wherein a control unit is provided for controlling the circulating cableway. The present disclosure further relates to a method for operating such a circulating cableway. The present disclosure further relates to a method for operating a circulating cableway having at least two cableway stations and having a number of cableway vehicles which can move between the cableway stations by means of a conveyor cable, wherein the number of cableway vehicles each has a cabin for receiving objects, and wherein the circulating cableway is controlled by a control unit.

BACKGROUND

In circulating cableways, the cableway vehicles are moved between two end stations in a circulating loop in a known manner. In the past, circulating cableways were used primarily for passenger transport in ski resorts. This mainly involved transporting skiers with ski equipment between a valley station and a mountain station. Later, this also included snowboarders with snowboards. In the case of smaller cabins, the skis and snowboards are usually transported in standardized transport baskets which are provided for this purpose on the outside of the cabins. In the case of larger cabins, usually all of the equipment is transported inside the cabins. In addition to skis and snowboards, there is also further, somewhat bulky, winter sports equipment such as snow bikes or sleds, which usually have to be transported inside the cabin. Circulating cableways in ski resorts are also increasingly being used in the summer. For instance, baby carriages, wheelchairs, and mountain bikes are transported, and, due to their size, they are usually also transported inside the cabins.

However, circulating cableways are also being used increasingly as public transport in the urban space. In this case, too, objects are often transported in addition to purely passenger transport, wherein the range of different object types is generally greater than in ski resorts. Especially in the urban space, in addition to the objects already mentioned, luggage items, e.g., suitcases or bags, or goods are often transported. Due to the large range of objects, the use of standardized transport baskets outside the cabins is not easily possible. In addition to the above-mentioned objects used by people, goods are also often transported—for example, food or the like. Unlike the other objects mentioned, such goods are usually non-personal goods and are therefore usually not carried by the people in the cabins. For example, goods are loaded by the operating personnel in a first cableway station, e.g., a valley station in a ski resort, into a cabin and are transported unattended up to a second cableway station, e.g., a mountain station. In the mountain station, the goods are then unloaded from the cabin by the operating personnel. The cableway vehicles can, for example, be used for the mixed transport of people and goods, or they can be used exclusively for the transport of goods. However, cableway vehicles with specially designed transport cabins can also be provided, for example, and are intended exclusively for the movement of goods.

Due to the large range of objects to be transported, different challenges arise when loading and unloading. While the loading of hand-held, personal objects (e.g., skis, suitcases, etc.) is relatively simple and fast, for example, loading the cabins with bulky personal objects (e.g., wheelchair, bicycle, baby carriage, etc.) and/or with bulky, non-personal objects (e.g., goods such as food, etc.) may be more complex and therefore take more time. However, in conventional circulating cableways, the cableway vehicles are usually moved in a specified normal operating mode at a specified constant conveying speed.

The cabin doors are usually opened and closed automatically at fixed positions within the cableway stations. The position, time point, and available time for loading or unloading the cableway vehicles are therefore fixed and unchangeable in the normal operating mode. Particularly at peak times, this can lead to accidents or undesirable emergency stops because there is sometimes too little time available for loading. Until now, the drive has been stopped at best manually by the operating personnel when the operating personnel have detected certain objects. However, because the future trend is increasingly toward unattended operation, manual intervention is not a satisfactory solution. In addition, reliable detection of objects that may require a stop cannot be guaranteed due to distraction or other activities.

Systems which can reduce manual intervention by the operating personnel are known. AT 414 056 B uses a video camera to monitor a lift route and its surroundings in order to assess the movement of objects in terms of their position and speed. If the movement of an object causes a hazardous situation, an evaluation unit initiates an alarm signal or switches off the drive of the cableway. EP 1 972 520 A1 makes it possible to adapt the operating mode of the cableway as required in the cableway station. For example, the conveying speed of the cableway vehicles is varied. In EP 1 849 674 A1, the conveying speed of the cableway vehicles is adjusted according to the type of cableway vehicle. In these systems, however, the operating mode of the cableway in not adapted as a function of the object to be transported.

SUMMARY

It is therefore an object of the present disclosure to provide a circulating cableway and a method for operating a circulating cableway which enable simpler transport of objects and increase personal safety.

This object may be achieved by providing, in a first cableway station, a first detection device which may be configured to detect an object provided for loading a cabin of a cableway vehicle in a loading region of the first cableway station and to determine an object type for the object, and by the control unit being configured to operate the circulating cableway in a defined transport operating mode when the object type determined for the detected object is a specified object type. As a result, automatic detection and identification of desired objects is made possible, and the operating mode of the cableway can be adapted on the basis thereof. In the case of mixed operation (transporting passengers and goods), the loading region can be located for example in the boarding area for the passengers. However, the loading region could also be located, for example, before or after the boarding area for the passengers as viewed in the movement direction.

In one embodiment of the present disclosure, the first detection device has at least one camera for capturing the loading region, and an evaluation unit which may be configured to detect the object located in the loading region from a number of images captured by the at least one camera and to determine the object type for the object, wherein the at least one camera preferably comprises a 3D camera, an infrared camera, or a video camera, and wherein an image recognition model preferably is stored in the evaluation unit. The image recognition model can comprise, for example, a suitable image recognition algorithm, e.g., in the form of an artificial intelligence (AI) model, which can be trained in order to be able to distinguish the desired objects from other objects. The training can be carried out, for example, by first providing the model with a plurality of images of objects of the specified object type. With a sufficiently large number of images, the model learns to recognize the specified object types automatically in later operation. Depending upon how complex the specified object types are, a suitable model and also a suitable camera can be used. The at least one camera can be arranged above the loading region, for example.

The circulating cableway may also have a drive device for driving the cableway vehicles, and in embodiments of the present disclosure, the transport operating mode may include a loading operating mode. The control unit may be configured to control the drive device in the loading operating mode in order to stop a drive of the cableway vehicles for a specified loading period or to reduce a conveying speed for a specified loading period when a cableway vehicle is located, at a loading time point, in the loading region of the first cableway station. The loading time point in this case may be specified as a function of a detection time point at which the object of the specified object type is detected by the first detection device. As a result, the drive can be stopped automatically, e.g., without intervention by the operating personnel, if a particular object which, according to experience, requires a relatively large amount of time for loading is detected. It can also be sufficient, for example, for certain objects if only the conveying speed is reduced, so that more time is available to load the object than in the normal operating mode. The loading period can vary, for example, as a function of the object type.

The transport operating mode may also include an unloading operating mode, wherein the control unit may be configured to control the drive device in the unloading operating mode in order to stop the drive of the cableway vehicles for a specified unloading period or to reduce the conveying speed for a specified unloading period when the cableway vehicle which is loaded with an object of the specified object type is located, at an unloading time point, in a specified unloading region of a second cableway station. As a result, in a specified unloading region, analogously to the loading region, the drive can be stopped automatically, or the conveying speed can be reduced, in order to facilitate the unloading of the object. This is particularly advantageous if, for example, no operating personnel are available in the exit area of a cableway station (e.g., a mountain station) to monitor the exit area or unloading region. The unloading period can in turn vary, for example, as a function of the object type. In the case of mixed operation (people and objects), the unloading region can, for example, again be in the exit area, but could also be located in front of or after the exit area in the movement direction.

In embodiments in which a cabin door is provided on each of the cabins of the number of cableway vehicles, and a door actuation device is provided for actuating the cabin doors, wherein the control unit can control the door actuation device, the transport operating mode then may also include a pass-through operating mode, wherein the control unit may be configured to control the door actuation device in the pass-through operating mode in such a way that, in the case of a cableway vehicle which is loaded with an object of the specified object type, the cabin door is closed in a specified pass-through region of a cableway station. This can be advantageous, for example, if only an object, e.g., food or the like, is being transported in mixed operation by a cableway vehicle. As a result, the cabin door can remain closed, e.g., in a central station, so that people cannot board the cabin.

In some embodiments, the control unit may be configured to determine the unloading time point on the basis of a running time of the cableway vehicles between the loading region and the unloading region and/or on the basis of a unique vehicle identifier of the cableway vehicles. The running time depends upon the route length and the conveying speed, and can be assumed to be known. The control unit can determine the unloading time point, for example, from the known loading time point, the loading period, and the running time. If the cableway vehicles have vehicle identifiers, the control unit knows at any time point where the cableway vehicles are located and can determine the unloading time point accordingly.

In some embodiments, a first vehicle identification device can be provided in the first cableway station and is configured to detect the vehicle identifier of a cableway vehicle located in the loading region, and the control unit can be configured to use the detected vehicle identifier to determine the unloading time point. For example, the first detection device could, in addition to object recognition, also be configured as a vehicle identification device for detecting the vehicle identifier. For example, a unique optical feature which is provided on the outside of the cableway vehicle and is suitable for being identified by means of image recognition could be used as the vehicle identifier. However, the first vehicle identification device could also be a separate device which is provided in addition to the first detection device. For example, a QR Code, barcode, or RFID transponder can be used as the vehicle identifier, and the first vehicle identification device can have a corresponding reading device.

In some embodiments, second vehicle identification device can also be provided in the second cableway station and may be configured to detect the vehicle identifier of the cableway vehicles, and the control unit can be configured to determine the unloading time point on the basis of the detected vehicle identifier. The second vehicle identification device can be configured, for example, analogously to the first detection device and have a detection device having at least one camera and an evaluation unit. However, the second vehicle identification device can also have a suitable reading device for reading a QR code, barcode, or RFID transponder. In this case, the control unit can determine the unloading time point on the basis of the signal of the second vehicle identification device and use it to switch to the unloading operating mode, even without knowledge of the running time.

In some embodiments, a signaling device is provided in at least one cableway station, and for the control unit may be configured to control the signaling device to reproduce a signal when the circulating cableway is in the transport operating mode. The signal can comprise, for example, an optical, acoustic, or electronic signal. In this way, passengers or the operating personnel can be warned with desired signals or be informed with suitable information. Depending upon the desired type of signal, a suitable signaling device can be provided—for example, signal lamps, loudspeakers, screens for displaying information, a mobile terminal for displaying electronic messages, etc.

Embodiments of the present disclosure may include a circulating cableway configured as a cabin cableway, wherein each cableway vehicle of the number of cableway vehicles comprises a cabin, or the circulating cableway can be configured as a combination lift, wherein the number of cableway vehicles comprises a number of cableway vehicles having chairs and a number of cableway vehicles having cabins. In this case, the detection and analysis of objects according to the present disclosure may be done in the boarding or exit areas provided for the cabin vehicles.

The specified object type may include at least one of the following object types: suitcase, transport pallet, crate, platform trolley, bicycle, baby carriage, wheelchair, scooter, and object having a size exceeding a specified size. This allows the most common object types to be recognized, wherein this list is of course not exhaustive. Object types that have not been taken into account can, for example, be added subsequently—for example, by re-training the image recognition model.

The object may be additionally achieved with embodiments of the method mentioned at the outset, as follows: a first detection device detects an object which is loaded into a cabin of a cableway vehicle in a loading region of a first cableway station and an object type is determined for the object, and the control unit operates the circulating cableway in a defined transport operating mode when the object type determined for the detected object is a specified object type.

BRIEF DESCRIPTION OF THE FIGURES

In the following, the present disclosure shall be described in more detail with reference to FIG. 1, which, by way of example, shows schematic and non-limiting advantageous embodiments of the present disclosure. Shown is:

FIG. 1 a circulating cableway in an exemplary embodiment of the present disclosure.

DETAILED DESCRIPTION

The following description of technology is merely exemplary in nature of the subject matter, manufacture and use of one or more inventions, and is not intended to limit the scope, application, or uses of any specific invention claimed in this application or in such other applications as may be filed claiming priority to this application, or patents issuing therefrom. The following definitions and non-limiting guidelines must be considered in reviewing the description of the technology set forth herein.

In the following detailed description numerous specific details are set forth in order to provide a thorough understanding of the present disclosure. However, it will be understood by those skilled in the art that the present disclosure may be practiced without these specific details. For example, the present disclosure is not limited in scope to the particular type of industry application depicted in the figures. In other instances, well-known methods, procedures, and components have not been described in detail so as not to obscure the present disclosure.

The headings and sub-headings used herein are intended only for general organization of topics within the present disclosure and are not intended to limit the disclosure of the technology or any aspect thereof. In particular, subject matter disclosed in the "Background" may include novel technology and may not constitute a recitation of prior art. Subject matter disclosed in the "Summary" is not an exhaustive or complete disclosure of the entire scope of the technology or any embodiments thereof. Classification or discussion of a material within a section of this specification as having a particular utility is made for convenience, and no inference should be drawn that the material must necessarily or solely function in accordance with its classification herein when it is used in any given composition.

The citation of references herein does not constitute an admission that those references are prior art or have any relevance to the patentability of the technology disclosed herein. All references cited in the "Detailed Description" section of this specification are hereby incorporated by reference in their entirety.

FIG. 1 shows a circulating cableway 1 having three cableway stations 2*a*-2*c*. In the following, the term, "cableway," is used synonymously for circulating cableway. The cableway 1 has a number of cableway vehicles 3 which can be moved between the cableway stations 2*a*-2*c* by means of a conveyor cable 4. The first cableway station 2*a* and the second cableway station 2*b* may be end stations, at each of which the conveyor cable 4 is diverted around a pulley 15 in order to form a closed cable loop. The cableway vehicles 3 can be moved along this cable loop in a circulating movement. The third cableway station 2*c* is only optional and may be a central station located between the two end stations 2*a*, 2*b*. In the third cableway station 2*c*, a pulley 15 is also provided here by way of example. However, the conveyor cable 4 is not diverted inside the third cableway station 2*c*, but, rather, extends straight through the cableway station 2*c*. The pulley 15 is used essentially for guiding the conveyor cable 4.

It is also conceivable to separate the conveyor cable 4 into two cable loops, for example. In this case, a first conveyor cable would be provided, which forms a closed first cable loop between the first cableway station 2*a* and the third cableway station 2*c* (central station), and a second conveyor cable would be provided, which forms a closed second cable loop between the third cableway station 2*c* (central station) and the second cableway station 2*b*. In the third cableway station 2*c*, a first pulley is thus provided, around which the first conveyor cable is diverted, and a second pulley is provided, around which the second conveyor cable is diverted. Of course, the embodiment with three cableway stations 2*a*-2*c* is only exemplary, and the central station 2*c* could in principle also be omitted.

A drive device 9 for driving the cableway vehicles 3 is also provided in the cableway 1. The drive device 9 has at least one first drive unit 9*a*, e.g., a suitable electric machine, for driving the conveyor cable 4. The first drive unit 9*a* can be arranged, for example, in one of the cableway stations 2*a*-2*c* and can be configured to drive the pulley 15. In the illustrated embodiment according to FIG. 1, a first drive unit 9*a* is provided in the second cableway station 2*b* by way of example. Optionally, however, further first drive units 9*a* can also be provided in the other cableway stations 2*a*, 2*c* in order to drive the respective pulleys 15. This can be advantageous, for example, for allowing redundancy of the drive or for particularly large cable lengths and/or particularly large loads and/or large gradients.

The illustrated cableway 1 may be a cabin cableway in which all of the cableway vehicles 3 each have a cabin K for receiving objects O. Of course, the cabins K can also be provided for transporting people. In the context of the present disclosure, it is thus possible to use conventional cabin vehicles which are predominantly used for passenger transport and which, if necessary, can also be used for transporting goods. A cabin door 12 is provided on the side of each of the cabins K in a known manner and can, for example, have two door leaves that can be opened in opposite directions, as indicated in FIG. 1 on a cableway vehicle 3 in the first cableway station 2*a*. The cabin doors 12 are arranged in such a way that they each face a platform 16 in the cableway stations 2*a*-2*c*. People can board or objects O can be loaded into the cabins K via the platform 16.

The cableway vehicles 3 can be detachably coupled to the conveyor cable 4 in a known manner. Actuatable cable clamps (not shown) are provided on the cableway vehicles 3 for this purpose. While traveling on the free section between the cableway station stations 2*a*-2*c*, the cable clamp of a cableway vehicle 3 is closed, so that the cableway vehicle is fixedly coupled to the conveyor cable 4. The drive force generated by the first drive unit 9*a* is thereby transmitted frictionally via the cable clamp from the conveyor cable 4 to the cableway vehicle 3. When entering a cableway station 2*a*-2*c*, the cable clamp can be opened by an actuation device (not shown) in order to decouple the cableway vehicle 3 from the conveyor cable 4. While the conveyor cable 4 is moved further around the pulley 15 at a substantially unchanged and constant conveying speed, the cableway vehicle 3 decoupled in the entry region E can be decelerated after the decoupling and moved at reduced speed from the entry region E to an exit region A of each cableway station 2*a*-2*c*.

In order to guide the decoupled cableway vehicles 3, stationary guide rails 17 are provided in the cableway stations 2*a*-2*c*. The guide rails 17 extend from the entry region E to the exit region A of each cableway station 2*a*-2*c*. In the exit region A, the cableway vehicles 3 can initially be accelerated again to the conveying speed of the conveyor cable 4, and the cable clamps of the cableway vehicles 3 can be actuated by an actuation device (not shown) in order to re-couple the cableway vehicle 3 to the conveyor cable 4. A number of guide rollers (not shown) can be provided on each of the cableway vehicles 3, and, by means of the guide rollers, the cableway vehicles 3 can be guided along the guide rails 17 in the state in which they are decoupled from the conveyor cable 4.

In order to drive the decoupled cableway vehicles 3 along the guide rails 17, one auxiliary drive (not shown) per guide rail 17 can be provided in the cableway stations. The auxiliary drive can be configured, for example, in the form of a known tire conveyor, which has a plurality of driven tires arranged one after the other along each guide rail 17. The tires can interact with friction linings on the cableway vehicles 3 in order to drive the cableway vehicles 3. To drive the auxiliary drives, a suitable second drive unit 9*b*, e.g., an electric machine, can be provided in each case. The second drive unit 9*b* is indicated merely by way of example in the second cableway station 2*b*. Of course, a second drive unit 9*b* is also provided in an analogous manner in the first cableway station 2*a*. A guide rail 17 is provided in the third cableway station 2*c* for each direction of travel, wherein a separate auxiliary drive having a second drive unit 9*b* is provided for each guide rail 17.

Furthermore, at least one control unit 5 for controlling functions of the cableway 1 is provided in the cableway 1. The control unit 5 serves, inter alia, to control the drive device 9, and in particular to control the available first drive unit(s) 9*a* for driving the conveyor cable 4 and for controlling the available second drive unit(s) 9*a* for driving the auxiliary drives. In addition, the control unit 5 may be configured to control further functions which, however, are not relevant to the present disclosure—for example, for lighting control, etc. The position of the control unit 5 is shown merely by way of example in FIG. 1. The control unit 5 can be located, for example, in one of the cableway stations 2*a*-2*c*—for example, in a control room of a cableway station 2*a*-2*c*. The control unit 5 could also have several separate control units, for example, which communicate with one another via a suitable communications link. The control unit 5 can have suitable hardware and/or software.

The first cableway station 2*a* can, for example, be a valley station in a valley of a ski resort, and the second cableway station 2*b* can be a mountain station on a mountain of the ski resort. The third cableway station 2*c* can be located at a suitable location between the mountain and the valley. During operation of the cableway 1, the transport of people and objects O is therefore mainly from the valley to the mountain. However, transport from the mountain to the valley is also possible, of course. People transport can of course also take place. Of course, the use in a ski resort is only exemplary, and the cableway 1 could alternatively also be provided for urban operation, for example. In this case, a height difference does not necessarily have to be bridged; it could also be a movement across one plane, or a movement with only a small height difference, or bridging of a river, etc. In this case, transporting people and/or goods can also take place in substantially the same parts in both directions. For the description of the present disclosure, however, only the goods transport of objects O in one direction from the valley station 2*a* to the central station 2*c* or further to the mountain station 2*b* is considered in the following.

A loading region 6 for loading cableway vehicles 3 with objects O is provided on the platform 16 before the exit region A of the first cableway station 2*a*. The loading region 6 is to be understood here to mean that region in which the cabin doors 12 on the cabins K of the cableway vehicles 3 traveling past are opened. In the example shown, there is only one cableway vehicle 3 in the loading region 6 at any given time point. Contrary to the illustration shown, however, the loading region 6 could also be longer in the movement direction B of the cableway vehicles 3, so that several cableway vehicles 3 can be located in the loading region 6 at the same time. In the case of mixed operation (transporting goods+passengers), the loading region 6 can at the same time serve, for example, as a boarding area for people. The loading region 6 could, however, also be separated from the boarding area for people, for example, and be located, for example, before or after the boarding area on the platform 16 in the movement direction B.

Furthermore, a first detection device D1 is provided in the first cableway station 2*a* and may be configured to detect an object O provided for loading a cabin K of a cableway vehicle 3 in the loading region 6 and to determine an object type for the object O. In the example shown, the first detection device D1 has a camera 7 and an evaluation unit 8. The camera 7 is used to detect the loading region B and to generate a number of images. Of course, it is also possible for several cameras 7 to be provided. The camera 7 can, for example, have a 3-D camera or an infrared camera. The camera 7 can also have a video camera which can capture a temporal sequence of images of the loading region 6.

The camera 7 is in this case mounted at a suitable location in the first cableway station 2*a*, so that the loading region 6 can be captured, to the furthest extent possible, without interference or weather influences. The camera 7 can be mounted, for example, in an upper region of the cableway station 2*a* on a stationary structure, so that an image axis of the camera 7 is substantially normal to the platform 16 on which the loading region 6 is located. It can be sufficient, for example, if a single camera 7 is used, wherein it is possible for the object recognition to be carried out by the evaluation unit 8 on the basis of the normal projection of the objects O located in the loading region 6 onto the image plane. Advantageously, however, several cameras 7 arranged at different positions are used, or a 3-D camera is used in order to generate a three-dimensional image of the objects O.

The evaluation unit 8 may be configured to detect the object O located in the loading region B from the images captured by the camera 7 and to determine the object type for the object O. The following object types, inter alia, can be specified as the specified objects types: suitcase, transport pallet, crate, platform trolley, bicycle, baby carriage, wheelchair, scooter, and object having a size exceeding a specified size. For example, a projected area of the object O or a smallest circumscribed rectangular surface can be used as a measure of the size. Of course, the list of object types is not exhaustive and can be supplemented by further desired objects O. It would of course also be conceivable to supplement the list with object types not taken into account at the outset.

To detect the objects O and identify the object type, a suitable image recognition model can be stored in the evaluation unit 8, for example. In the example shown, the evaluation unit 8 may be configured as a separate unit and is connected to the camera 7 via a suitable first communications link 18 and is connected to the control unit 5 via a suitable second communications link 19. The camera 7 can transmit the captured images to the evaluation unit 8 via the first communications link 18, and the evaluation unit can process the images in order to detect an object O and to identify the object type. The evaluation unit 8 can send this information via the second communications link 19 to the control unit 5, and the control unit 5 can operate the circulating cableway 1 in a defined transport operating mode when the object type determined for the detected object O is a specified object type, as will be explained in more detail below.

Contrary to the embodiment shown, however, the evaluation unit 8 could also be integrated, for example, into the camera 7, e.g., as a smart camera. Alternatively, however, the evaluation unit 8 could also be integrated into the control unit 5—for example, in the form of suitable software. A suitable algorithm in the form of artificial intelligence (AI model) can be used as an image recognition model, for example. Such an algorithm can, for example, be an artificial neural network, which enables machine learning. The AI model can first be trained with a large amount of data in order to detect particular objects O and to identify the associated object type. Such models are known in the prior art, and therefore no detailed description is given here. For use in the context of the present disclosure, a person skilled in the art can select a suitable image recognition model.

The transport operating mode can comprise, for example, a loading operating mode. In the loading operating mode, the control unit 5 can control the drive device 9 (first drive unit 9*a* and/or second drive unit 9*b*) of the cableway 1 in order to, at a loading time point, stop a drive of the cableway vehicles 3 for a specified loading period or reduce a conveying speed for a specified loading period. This means, for example, that, when an object O that corresponds to a specified object type has been detected in the loading region 6, the drive can be stopped automatically and without intervention by the operating personnel. The object O can then be loaded by a person through the open cabin door 12 of the cabin K of the cableway vehicle 3 located in the loading region 6. Particularly in the case of relatively large and heavy objects O, this is advantageous, because a longer loading period is available compared to the normal operation.

The loading period can, for example, be fixed or could also be adjustable—for example, via a user interface in a control room of a cableway station 2*a*-2*c*. The loading period does not have to be the same for all objects O; rather, for example, different object types could be assigned loading periods of different lengths. This makes it possible to take into account the fact that the loading of some objects O, e.g., a suitcase, proceeds relatively quickly, while the loading of bulky objects O, such as bicycles, takes much longer. The drive could also be stopped for some object types, while for other object types only the conveying speed is reduced.

After the loading period has elapsed, the control unit 5 can automatically restart the normal operation by restarting the drive device 9 or by increasing the conveying speed again. Alternatively, however, the normal operating mode could also be resumed only by manual intervention. After the object O has been loaded and the cabin door 12 has been closed, the cableway vehicle 3 can be moved in a conventional manner to the second cableway station 2*b* or, if available, optionally only up to the third cableway station 2*c* (central station). As soon as a new object O corresponding to a specified object type is detected in the loading region 6, the control unit 5 can automatically switch back into the loading operating mode, etc. The loading time point is preferably specified as a function of a detection time point at which the object type is detected by the first detection device D1. "As a function of" can mean, for example, that the loading time point corresponds to the detection time point, but could also be a specific time after the detection time point.

In order for the object O loaded in the first cableway station 2*a* to be unloaded from the cableway vehicle 3 in the second cableway station 2*b* and/or in the third cableway station 2*c*, a suitable unloading region 10 can be specified. Similarly to the loading region 6, the unloading region 10 can, in mixed operation (transporting goods+passengers), also serve as an exit area for people. Alternatively, however, the unloading region 10 could again be located before or after the exit area for the people in the movement direction. In FIG. 1, only an exemplary unloading region 10 is provided in the second cableway station 2*b*. Of course, in addition (or alternatively), a corresponding unloading region (not shown) could also be provided in the third cableway station 2*c*. In order to be able to unload the object O from the cableway vehicle 3 in the unloading region 10, the transport operating mode advantageously also comprises an unloading operating mode.

In a similar way to that of the loading operating mode, the control unit 5 correspondingly controls the drive device 9 (first drive unit 9*a* and/or second drive unit 9*b*) in the unloading operating mode in order to stop the drive of the cableway vehicles 3 for a specified unloading period or to reduce a conveying speed for a specified unloading period when the cableway vehicle 3 which is loaded with the object O of the specified object type is located, at an unloading time point, in the unloading region 10 of the second cableway station 2*b*. In order to determine the unloading time point at which the cableway vehicle 3 which is loaded with an object O of the specified object type is located in the unloading region 10 of the second cableway station 2*b*, there are various possibilities, as will be explained below.

The control unit 5 may be configured, for example, to determine the unloading time point on the basis of a running time of the cableway vehicles 3 between the loading region 6 of the first cableway station 2*a* and the unloading region 10 of the second cableway station 2*b*. The running time is generally known or can be determined on the basis of a route length and a conveying speed. The route length can be assumed to be known, or could optionally also be measured. The conveying speed can also be assumed to be known or can optionally also be measured by a sensor, e.g., on the conveyor cable 4 or on the drive device 9, or can be determined from other available variables, e.g., a rotational speed of the first drive unit 9*a*. The control unit 5 can then calculate the unloading time point, e.g., proceeding from the loading time point, on the basis of the running time between the loading region 6 and the unloading region 10. As already mentioned, the loading time point can, for example, be the time point at which an object O of a specified object type is detected by the first detection device D1. The control unit 5 can then calculate the unloading time point, e.g., proceeding from the loading time point, from a sum of the specified loading period and the running time.

Alternatively, each cableway vehicle 3 could also have a unique vehicle identifier X, and the control unit 5 could determine the unloading time point, at which the cableway vehicle 3 which is loaded with an object O of the specified object type is located in the unloading region 10 of the second cableway station 2*b*, on the basis of the vehicle identifier X. The positions of the cableway vehicles 3 along the conveyor line can be assumed to be known. Thus, the control unit 5 has, at any given time, knowledge of where a cableway vehicle 3 with a specific vehicle identifier X is located on the route (including the cableway stations). The control unit 5 can then, for example, determine, on the basis of the loading time point, the vehicle identifier X of the cableway vehicle 3 into which the object O of the specified object type is loaded in the loading region 6 of the first cableway station 2*a*. The unloading time point is then the time point at which the cableway vehicle 3 with the corresponding vehicle identifier X is located in the unloading region 10 of the second cableway station 2*b*.

A first vehicle identification device could also be provided in the first cableway station 2*a*, and may be configured to detect the vehicle identifier X of a cableway vehicle 3 which has been loaded with an object O of a specified object type in the loading region 6 of the first cableway station 2*a*, and transmit said vehicle identifier X to the control unit 5. In this case, the vehicle identifier X could, for example, be a QR code, a barcode, or an RFID transponder (RFID=radio frequency identification) which is provided at a suitable location of the cableway vehicles 3, and the vehicle identification device could have a suitable reading device for reading the QR code, barcode, or the RFID transponder. The control unit 5 can then use the vehicle identifier X, detected by the reading device, of the cableway vehicle 3 which is located, at the loading time point, in the loading region 6, to determine the unloading time point in the unloading region 10. This can be carried out via the known position of the cableway vehicle on the route, via the running time, or by providing in the second cableway station 2*b* a second vehicle identification device which transmits the detection and thus the presence of the cableway vehicle 3 with the corresponding vehicle identifier X to the control unit 5.

Advantageously, the first detection device D1 of the first cableway station 2*a* could (in addition to object recognition) also be used as the first vehicle identification device. In this case, the first detection device D1 may be configured to detect the vehicle identifier X of the cableway vehicle 3 which has been loaded with an object O of a specified object type in the loading region 6 and to transmit said vehicle identifier X to the control unit 5. To this end, for example, a characteristic optical feature which is provided on the cabin K of the cableway vehicles 3 and can be detected by the evaluation unit 8, e.g., by means of the image recognition model, can serve as the vehicle identifier X. It would be conceivable, for example, to provide an identification number or a unique illustration, which, for example, is attached to the cabin K in the form of a sticker.

In the second cableway station 2*b*, a second detection device D2 could be provided as the second vehicle identification device, which may be configured to detect the vehicle identifier X and to transmit said vehicle identifier X to the control unit 5. The second detection device D2 may be configured in the same way as the first detection device D1, wherein, optionally, only a detection of the vehicle identifier X is necessary, and not necessarily a detection of objects O of the specified object type. The control unit 5 can then operate the cableway 1 in the unloading operating mode when the second detection device D2 has transmitted the vehicle identifier X of the cableway vehicle 3 which has been loaded with an object O of a predetermined object type in the loading area 6 of the first cableway station 2*a*.

In conventional cableways, the cabin doors 12 are usually opened and closed by means of mechanical forced control, e.g., a slotted guide system. A stationary guide arranged in the cableway station 2*a*-2*c* interacts with an actuating element of the cableway vehicle 3 in order to open or close the cabin door in question. Usually, an opening guide rail for opening the cabin doors 12 is arranged in the entry region E of each cableway station 2*a*-2*c* before the unloading region 10 (and optionally the exit area for people) in the movement direction B. In addition, a closing guide rail for closing the cabin doors 12 is arranged in the exit region A of each cableway station 2*a*-2*c* after the loading region 6 (and optionally the boarding area for people) in the movement direction B. This forced control is a passive control system, wherein the cabin doors 12 are opened or closed only due to the movement of the cableway vehicles 3 relative to the relevant guide. The open and closed positions or the opening and closing time points thus depend upon the arrangement of the guides in the cableway station 2*a*-2*c* and are therefore fixed and cannot be changed (other than with large construction effort).

According to a further advantageous embodiment of the present disclosure, a door actuation device 13 for actuating the cabin doors 12 of the cableway vehicles 3 can be provided in at least one of the cableway stations 2*a*-2*c* and can be controlled by the control unit 5 for opening and/or closing. It is already known that, alternatively or in addition to the forced control, an active door actuation can be provided by means of a door actuation device 13. The door actuation device 13 is shown in FIG. 1 by way of example in the third cableway station 2*c*. The door actuation device 13 can have movable guide elements (not shown in FIG. 1), by means of which an actuating force can be exerted on the relevant actuating element of the cableway vehicle 3 in order to open or close the cabin door(s) 12. To generate the actuating force, at least one electrically-controllable actuator, e.g., a hydraulic cylinder, pneumatic cylinder, or servomotor, can be provided on each of the movable guide elements. If a cableway vehicle 3 is located in the region of the movable guide element of the door actuation device 13, the control unit 5 can control the corresponding actuator in order to open or close the cabin door 12. As a result, the opening and/or closing of the cabin doors 12 can be actively controlled by the control unit 5. The door actuation device 13 can be arranged at a desired location of the cableway station 2*c*, where the opening or closing is desired.

Alternatively, however, each door actuation device 13 could also have, on the cableway vehicles 3, an electrically-controllable door actuator (not shown in FIG. 1) which can be controlled by the control unit 5 in order to open or close the cabin door 12. As a result, the open or closed position inside the cableway station 2*c* can be specified very flexibly, and substantially freely. In this embodiment, the open or closed position is therefore not bound to a position of a guide of the cableway station 2*c*.

If an actively-controllable door actuation device 13 is provided, the transport operating mode can comprise a pass-through operating mode. In the pass-through operating mode, the control unit 5 controls the door actuation device 13 (e.g., the actuator of the movable guide element arranged in the cableway station 2*c* or the door actuator provided on the cableway vehicle 3) in such a way that, in the case of a cableway vehicle 3 which is loaded with an object O of the specified object type, the cabin door 12 is closed in a specified pass-through region 20 of a cableway station 2*a*-2*c*—in this case, the third cableway station 2*c*. If mechanical positive control is already provided for opening the cabin doors 12, the cabin door 12 can, for example, be actively closed again by the door actuation device 13 immediately after the forced-controlled opening, and remain in the closed state while the cableway vehicle 3 passes the pass-through region 20.

As a result, it is possible, for example, for the cabin door 12 of a cableway vehicle 3 which has been loaded with an object O in the loading region 6 of the first cableway station, and is thus occupied by the object O in the third cableway station 2*c*, to be moved through the third cableway station 2*c* (central station) with the cabin door 12 closed, as is indicated in FIG. 1. In this case, the pass-through region 20 corresponds substantially to the entire length of the platform 16, as indicated in FIG. 1. As a result, it can be ensured, for example, in the case of transporting specific goods (e.g., food and beverages), that people do not get into the cabin unintentionally, which is undesirable. In the case of bulky objects O, e.g., bicycles, baby carriages, etc., opening of the cabin door 12 can thereby be prevented, so that access to further people is not possible.

Of course, the pass-through operating mode is not limited to the third cableway station 2*c*, but could of course also be used in the second cableway station 2*b*. It would be conceivable, for example, for the unloading region 10 for objects O to be located after the boarding area (or a combined boarding/exit area) for people in the movement direction B. In this case, it can be advantageous if the cableway vehicle 3 loaded with the object O passes through the boarding area with the cabin door 12 closed, and the cabin door 12 is opened only in the unloading region 10. The pass-through region 20 thus corresponds substantially to the length between the entry region E of the cableway station 2*b* and the unloading region 10. The vehicle detection of the loaded cableway vehicle 3 can be carried out analogously, as has already been described in connection with the unloading time point, e.g., on the basis of the running time between the loading region 6 of the first cableway station 2*a* and the region to be passed through, the pass-through region, unique vehicle identifier X.

According to a further advantageous embodiment of the present disclosure, a signaling device 11 can be provided in at least one of the cableway stations 2*a*-2*c*, and the control unit 5 may be configured to control the signaling device 11 to reproduce a signal S when the circulating cableway 1 is in the transport operating mode. The signaling device 11 can, for example, be provided for informing passengers and/or for informing the operating personnel. FIG. 1 shows a signaling device 11, merely by way of example, in the form of a traffic light in the third cableway station 2*c*. The traffic light can have, for example, a green signal lamp and a red signal lamp. If the cableway 1 is in the normal operating mode, the control unit 5 can control the traffic light in order to switch on the green lamp. If the cableway 1 is in the pass-through operating mode, the control unit 5 can control the traffic light in order to switch on the red lamp. In this way, people can be informed via the red signal light that the cabin door 12 of the cableway vehicle 3 traveling past will remain closed.

Of course, the signaling device 11 shown is only to be understood as an example, and the signaling device 11 could also be of any design. A signaling device 11 could also be provided, additionally or alternatively, in the first cableway station 2*a* or in the second cableway station. The signaling device 11 may also be configured, for example, to reproduce information as a signal, e.g., via a screen. For example, the operating personnel in the second cableway station 2*b* or in the third cableway station 2*c* could be informed, in advance via the screen, of the object type of the object O which was loaded into a cableway vehicle 3 in the first cableway station 2*a*. Furthermore, it would be conceivable for the time remaining until a loaded cableway vehicle 3 enters to be displayed by means of the signaling device 11 in the second cableway station 2*b*. It would also be conceivable for the time until the specified loading period has elapsed to be displayed in the first cableway station 2*a*—for example, in the form of a countdown on a display. Likewise, the time until the specified unloading period elapses could be displayed in the second cableway station 2*a*.

Alternatively or additionally, however, the signaling device 11 may also be configured, for example, to reproduce an acoustic warning signal and/or an electronic signal. For example, a characteristic signal tone could be reproduced for each operating mode of the various transport operating modes. A warning tone which warns of the imminent starting of the cableway 1 could also be generated when the loading period or the unloading period has elapsed. In particular, in the case of cableways with only a few operating personnel, a signaling device 11 can also be provided, for example, which transmits an electronic signal to a mobile device—for example, a smartphone or a tablet computer. In this way, an employee of the operating personnel who is currently not in one of the cableway stations 2*a*-2*c* can be informed about a transport operating mode—for example, about the imminent arrival of a specific object O. It is therefore apparent that there are many possibilities for how the signaling device 11 may be configured, and therefore an exhaustive list is not possible at this point. Depending upon the specific embodiment of the cableway 1, a person skilled in the art can provide a suitable signaling device 11 in one or more cableway stations 2*a*-2*c*.

The illustrated circulating cableway 1 may be a cabin cableway, wherein each cableway vehicle 3 of the number of cableway vehicles 3 comprises a cabin K. However, the present disclosure is not limited thereto, but could also be used, for example, in a circulating cableway 1 configured as a combination lift. In this case, the number of cableway vehicles 3 comprises a number of cableway vehicles 3 having chairs (chair vehicles) for receiving people, and a number of cableway vehicles 3 having cabin K (cabin vehicles). Generally, a specific number of chair vehicles and a specific number of cabin vehicles are provided alternately, one after the other. For example, three chair vehicle can be followed by a cabin vehicle, etc. Usually, in a combination lift, a separate boarding area or exit area is provided for the chair vehicles. In such a case, as in the cabin cableway shown in FIG. 1, the detection devices D1, D2 according to the present disclosure are respectively provided in a loading region 6 or unloading region 10 for the cabin vehicles.

The preferred embodiments of the disclosure have been described above to explain the principles of the present disclosure and its practical application to thereby enable others skilled in the art to utilize the present disclosure. However, as various modifications could be made in the constructions and methods herein described and illustrated without departing from the scope of the present disclosure, it is intended that all matter contained in the foregoing description or shown in the accompanying drawings, including all materials expressly incorporated by reference herein, shall be interpreted as illustrative rather than limiting. Thus, the breadth and scope of the present disclosure should not be limited by the above-described exemplary embodiment but should be defined only in accordance with the following claims appended hereto and their equivalents.

What is claimed is:

1. A circulating cableway having at least two cableway stations and a plurality of cableway vehicles which can be moved between the cableway stations with a conveyor cable, wherein each cableway vehicle has a cabin for receiving objects, and wherein a control unit is provided for controlling the circulating cableway, comprising:

a first detection device in at least a first of the at least two cableway stations configured to detect an object provided for loading in a cabin of a cableway vehicle in a loading region of the first cableway station and to determine an object type for the object, and wherein the control unit is configured to operate the circulating cableway in a defined transport operating mode when the object type determined for the object is a specified object type.

2. The circulating cableway according to claim 1, wherein the first detection device comprises at least a first camera configured to capture the loading region, and an evaluation unit configured to detect the object located in the loading region from a number of images captured by the first camera and to determine the object type for the object, wherein the first camera comprises at least one of a 3-D camera, an infrared camera, and a video camera, and the evaluation unit is configured to store an image recognition model.

3. The circulating cableway according to claim 1, further comprising a drive device for driving the cableway vehicles, wherein the transport operating mode comprises a loading operating mode, and wherein the control unit is configured to control the drive device in the loading operating mode to stop the drive device or to reduce a conveying speed for a specified loading period when one of the cableway vehicles is located in the loading region of the first cableway station at a loading time point, wherein the loading time point is a function of a detection time point at which the object of the specified object type is detected by the first detection device.

4. The circulating cableway according to claim 3, wherein the transport operating mode further comprises an unloading operating mode, and wherein the control unit is configured to control the drive device in the unloading operating mode to stop the drive device or to reduce the conveying speed for a specified unloading period when one of the cableway vehicles loaded with an object of the specified object type is located in a specified unloading region of one of the cableway stations at an unloading time point.

5. The circulating cableway according to claim 4, wherein the control unit is configured to determine the unloading time point based on at least one of a running time of the cableway vehicles between the loading region and the specified unloading region (10) and a unique vehicle identifier of each of the cableway vehicles.

6. The circulating cableway according to claim 5, further comprising a first vehicle identification device in the first cableway station configured to detect the unique vehicle identifier of each cableway vehicle located in the loading region, and wherein the control unit is configured to determine the unloading time point based on the detected vehicle identifier.

7. The circulating cableway according to claim 6, further comprising a second vehicle identification device in at least a second of the cableway stations configured to detect the unique vehicle identifier of each of the cableway vehicles, wherein the control unit is configured to determine the unloading time point based on the detected vehicle identifier, and wherein the second vehicle identification device comprises a second detection device comprising at least a second camera and a second evaluation unit.

8. The circulating cableway according to claim 1, wherein each cabin includes a cabin door and a door actuation device configured to actuate the cabin door, wherein the control unit is configured to control each door actuation device, wherein the transport operating mode comprises a pass-through operating mode, and wherein the control unit is configured to control the door actuation device to close the associated cabin door when the associated cableway vehicle is loaded with an object of the specified object type and is in a specified pass-through region of at least the first cableway station in the pass-through operating mode.

9. The circulating cableway according to claim 1, further comprising a signaling device in at least one of the cableway stations, and wherein the control unit is configured to control the signaling device to reproduce a signal when the circulating cableway is in the defined transport operating mode.

10. The circulating cableway according to claim 1, wherein the plurality of cableway vehicles of claim 1 are cabin vehicles, and wherein the circulating cableway is a combination lift further comprising chair vehicles which can be moved between the cableway stations with the conveyor cable.

11. The circulating cableway according to claim 1, wherein the specified object type comprises at least one of the following object types: a suitcase, a transport pallet, a crate, a platform trolley, a bicycle, a baby carriage, a wheelchair, a scooter, and an object having a size exceeding a specified size.

12. A method for operating a circulating cableway having at least two cableway stations and a plurality of cableway vehicles which can move between the cableway stations by a conveyor cable, wherein each cableway vehicle has a cabin for receiving at least one object, and wherein the circulating cableway is controlled by a control unit, comprising the steps of:

detecting an object loaded into a cabin of one of the cableway vehicles in a loading region of a first of the cableway stations with a first detection device, determining an object type for the object, and operating the circulating cableway with the control unit in a defined transport operating mode when the object type determined for the detected object is a specified object type.

13. The method according to claim 12, wherein the first detection device comprises at least a first camera, wherein the loading region is captured by the first camera, and detecting an object located in the loading region with an evaluation unit from at least one image captured by the first camera, determining the object type for the object in the loading region with the evaluation unit, wherein the first camera comprises at least one of a 3-D camera and an infrared camera, and wherein the evaluation unit is configured to store an image recognition model.

14. The method according to claim 12, wherein the transport operating mode comprises a loading operating mode, in the loading operating mode, stopping a drive device of the cableway vehicles or reducing a conveying speed for a specified loading period at a loading time point at which one of the cableway vehicles is located in the loading region of the first cableway station, and wherein the loading time point is determined as function of a detection time point at which the object of the specified object type is detected by the first detection device.

15. The method according to claim 14, wherein the transport operating mode comprises an unloading operating mode, in the unloading operating mode, stopping the drive device or reducing the conveying speed for a specified unloading period at an unloading time point at which one of the cableway vehicles is loaded with an object of the specified object type and located in an unloading region of a second cableway station.

16. The method according to claim 15, wherein the unloading time point is determined based on at least one of a running time of the cableway vehicles between the loading region and the unloading region and a unique vehicle identifier of each of the cableway vehicles.

17. The method according to claim 16, further comprising the steps of:

detecting the unique vehicle identifier of each of the cableway vehicles in the loading region of the first cableway station with a first vehicle identification device, and determining the unloading time point based on the detected vehicle identifier.

18. The method according to claim 17, further comprising the steps of:

detecting the unique vehicle identifier of each of the cableway vehicles in the unloading region of the second cableway station with a second vehicle identification device, and determining the unloading time point based on the detected unique vehicle identifier, wherein the second vehicle identification device comprises a second detection device having at least a second camera and a second evaluation unit.

19. The method according to claim 12, wherein the transport operating mode comprises a pass-through operating mode, and wherein each cableway vehicle has a cabin door, and in the pass-through operating mode, keeping the cabin door of one of the cableway vehicles loaded with an object of the specified object type closed while the cableway vehicle is in a specified pass-through region of one of the cableway stations.

20. The method according to claim 12, further comprising the step of reproducing a signal with a signaling device when the circulating cableway is operated in the transport operating mode.

* * * * *